United States Patent [19]

Winkelman et al.

[11] Patent Number: 4,526,391

[45] Date of Patent: Jul. 2, 1985

[54] PORTABLE SHELTER

[76] Inventors: Robert A. Winkelman, 46550 County Rd. 653; Roland E. Nicholson, 46917 County Rd. 653, both of Paw Paw, Mich. 49079

[21] Appl. No.: 422,418

[22] Filed: Sep. 23, 1982

[51] Int. Cl.[3] ..... E04B 1/347

[52] U.S. Cl. ..... 280/12 S; 135/87; 280/20

[58] Field of Search ..... 280/12 S, 20; 296/168, 296/171, 173, 161, 156, 163; 135/88, 89, 106, 107, 109, 904, 87

[56] References Cited

U.S. PATENT DOCUMENTS

| | | | |
|---|---|---|---|
| 2,465,147 | 3/1949 | Butler | 280/12 S |
| 2,780,471 | 2/1957 | Lempke | 280/12 S |
| 2,960,992 | 11/1960 | Kipfel | 135/904 |
| 3,017,194 | 1/1962 | Anderson | 280/20 |
| 3,019,803 | 2/1962 | Moody | 135/88 |
| 3,458,231 | 7/1969 | Glass | 296/173 |
| 3,492,015 | 1/1970 | Kuhn | 280/125 |
| 3,507,293 | 4/1970 | Du Bray | 280/12 S |
| 4,239,247 | 12/1980 | Hinz | 280/12 S |

FOREIGN PATENT DOCUMENTS

| | | | |
|---|---|---|---|
| 2840613 | 3/1980 | Fed. Rep. of Germany | 296/161 |
| 7907204 | 3/1981 | Netherlands | 296/163 |

*Primary Examiner*—Joseph F. Peters, Jr.
*Assistant Examiner*—Joseph G. McCarthy
*Attorney, Agent, or Firm*—Flynn, Thiel, Boutell & Tanis

[57] ABSTRACT

A portable ice fishing shelter includes an integral, molded shell having a bottom wall, side and rear walls which extend upwardly from the peripheral edges of the bottom wall, and a top wall which extends between the upper edges of the side and rear walls. The shell is adapted to stand on the bottom wall in an upright position of use and has sliding surfaces on outward projections on the rear wall which can slidably support the shell on ice and snow to facilitate transport thereof. A seat is provided within the shell and compartments are provided between the seat and bottom wall for holding items such as fishing tackle, a lantern, and fish which have been caught. An optional snow blind includes two vertical panels, each having an edge pivotally supported on a front edge of a respective side wall. An optional hood includes a frame assembly pivotally supported at one end on an upper portion of the shell and having support legs at the opposite end thereof, and a fabric cover which is supported by the frame assembly and, in conjunction with the shell, provides a substantially enclosed shelter.

12 Claims, 8 Drawing Figures

PORTABLE SHELTER

FIELD OF THE INVENTION

This invention relates to a portable shelter and, more particularly, to a portable shelter which will provide protection from the elements to a person engaged in ice fishing.

BACKGROUND OF THE INVENTION

The sport of ice fishing typically requires that the fisherman remain in a fixed position on the frozen surface of a lake or pond for a relatively long period of time. The temperature of the ambient air is necessarily quite low, and the relatively large and flat area around the fisherman provides little or no protection from the wind, so that even a relatively light wind produces a wind chill effect which causes the effective temperature around the fisherman to be somewhat less than the actual temperature. Therefore, some form of shelter is desirable to protect the fisherman from the elements. Moreover, it is desirable that this shelter be portable in order to facilitate transport thereof to and from the lake or pond, as well as movement thereof to different locations on the lake or pond.

A number of devices have been developed to fill such a need, including those disclosed in U.S. Pat. Nos. 2,780,471 and 4,239,247. Although these prior art shelters have generally been adequate for their intended purposes, they have not been satisfactory in all respects.

More specifically, erection of a minimum shelter which includes a seat and a windbreaker next to the seat is somewhat complex and time consuming. Moreover, it may be necessary for the fisherman to remove his gloves in order to assemble these shelters, thereby making his hands cold at the beginning of an extended period outdoors.

In addition, the basic windbreaker in the prior art devices is typically a cloth covering of some kind and does not always provide a particularly effective windbreak, especially in high winds. Moreover, the fabric may be susceptible to wear which produces holes and tears, thereby rendering it even less effective as a windbreak.

Moreover, the known devices are adapted to carry items such as fishing tackle to and from the lake or pond, but do not have compartments for holding items such as tackle, caught fish and a heater or lantern during operational use.

Accordingly, it is an object of the present invention to provide a portable shelter which includes at least a seat and windbreaker for the fisherman and which can be erected almost immediately and without any need for the fisherman to remove his gloves. Erection of this minimum shelter preferably requires no assembly of component parts.

A further object of the present invention is the provision of a shelter, as aforesaid, which is relatively light and can easily be transported to and from the location of use.

A further object of the invention is to provide a portable shelter, as aforesaid, in which the windbreaker is made from a material other than a fabric.

A further object of the invention is the provision of a portable shelter, as aforesaid, which is adapted to hold fishing equipment during transport to and from the location of use and which has compartments available for use when the shelter is being used operationally.

A further object of the invention is the provision of a portable shelter, as aforesaid, which is rugged and substantially maintenance-free, and which is relatively simple and inexpensive to manufacture.

A further object of the invention is the provision of a portable shelter, as aforesaid, which includes an arrangement to keep blowing snow away from the hole in the ice and/or includes a mechanism which permits it to be quickly and easily converted into an enclosed shelter.

SUMMARY OF THE INVENTION

The objects and purposes of the invention, including those set forth above, are met by providing a portable shelter which includes a shell having spaced, upstanding side walls, an upstanding rear wall extending between the rear edges of the side walls, and a top wall extending between the upper edges of the side and rear walls. The shelter is adapted to stand in an upright position during use, and has a sliding surface on an outer side of the rear wall which can slidably support the shelter on ice and snow to facilitate transport thereof. A seat is provided within the shell between the side walls thereof.

In a preferred embodiment, the shell includes a bottom wall, the side and rear walls extending upwardly from the peripheral edges of the bottom wall and the shell being supported on the bottom wall during use. The bottom, side, rear and top walls are respective portions of an integral, molded unit, the top wall being inclined downwardly and rearwardly and merging smoothly into the rear wall. The seat is spaced above the bottom wall and at least one compartment is provided in the region between the side walls, seat and bottom wall.

A snow blind for the shelter includes at least two vertical first panels which are supported on and project forwardly from the forward edges of the respective side walls, preferably have widths less than the distance between the forward edges of the side walls, and are preferably each pivotally movable between a position generally parallel to each other and projecting forwardly to a position adjacent the seat and substantially parallel to the rear wall.

Another embodiment of the shelter, which can be quickly and easily converted into a substantially enclosed shelter, includes a frame assembly supported on the shell near the top thereof and extending forwardly therefrom, at least one generally vertical support leg supporting the end of the frame assembly remote from the shell, and a fabric cover supported on the frame assembly and extending downwardly to a location substantially adjacent the ground.

BRIEF DESCRIPTION OF THE DRAWINGS

The invention will be described in detail in connection with the accompanying drawings, in which.

Figure 1:
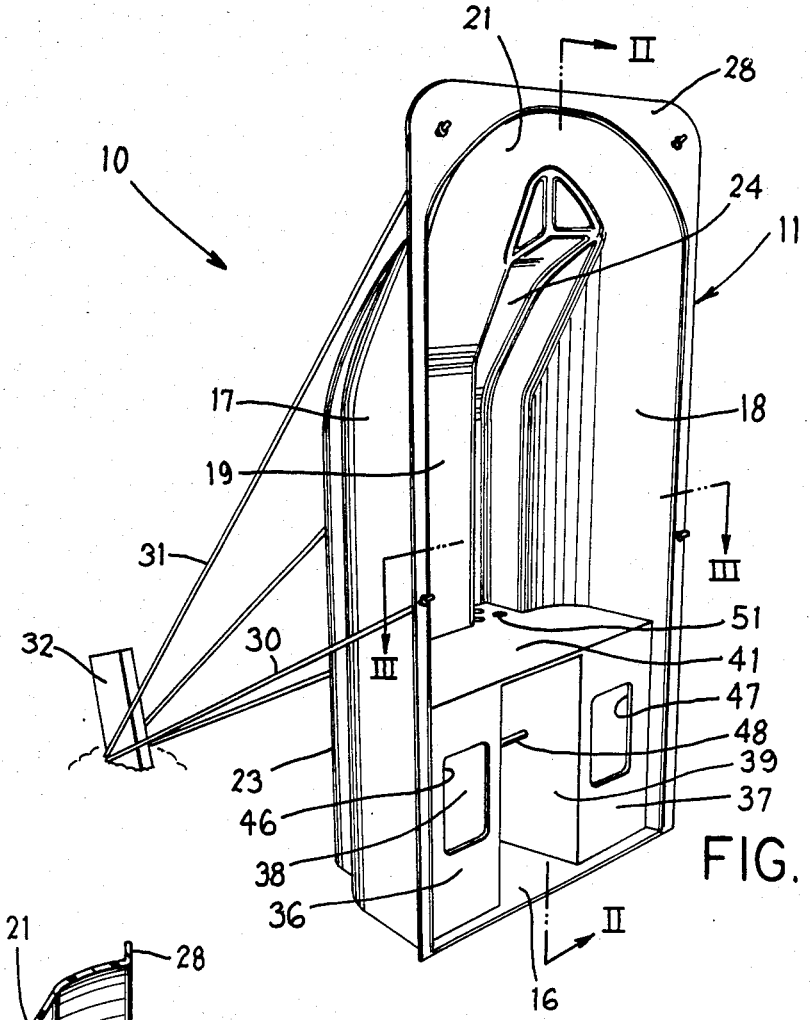
FIG. 1 is a perspective view of a portable shelter embodying the present invention.

Certain terminology is used herein for convenience in reference only and is not to be considered limiting. The words "up", "down", "front" and "rear" will designate directions in the drawings to which reference is made. The words "in" and "out" will respectively refer to directions toward and away from the geometric center of the shelter and designated parts thereof. This terminology will include the words specifically mentioned above, derivatives thereof and words of similar import.

DETAILED DESCRIPTION

Referring to FIG. 1, a portable shelter 10 includes a shell 11 which is preferably an integral unit made of a molded fiber glass or plastic material. The shell 11 includes a generally horizontal bottom wall 16, spaced side walls 17 and 18, a rear wall 19, and a top wall 21. The side walls 17 and 18 and rear wall 19 extend upwardly from peripheral edges of the bottom wall 16 on three sides thereof, the rear wall extending between the rear edges of the side walls 17 and 18. The top wall 21 extends between the upper edges of the side walls 17 and 18, is inclined generally downwardly and rearwardly, and merges smoothly with the upper end of the rear wall 19. In effect, the shell 11 has an opening only in its front side. The dimensions of the bottom wall 16 are sufficient to stably support the shell 11 in the upright position of use illustrated in FIG. 1.

The rear wall 19 has two parallel, vertically extending, outwardly projecting ridges 23 and 24. The outermost portions 26 and 27 (FIG. 3) of the ridges 23 and 24 serve as sliding surfaces, as described in greater detail hereinafter.

The shell 11 also has a rim or flange 28 which projects outwardly from the front edges of the side walls 17 and 18 and top wall 21.

Although the bottom wall 16, as mentioned above, has dimensions sufficient to support the shell 11 in its upright position of use in a relatively stable manner, guy ropes 30 and 31 can be secured to the shell 11 and attached to a stake 32 to further stabilize the shell 11 in its upright position of use. In the illustrated embodiment, holes are provided through the rim 28 of the shell 11 and the end of a guy rope is inserted through each such opening and then knotted.

Figure 3:
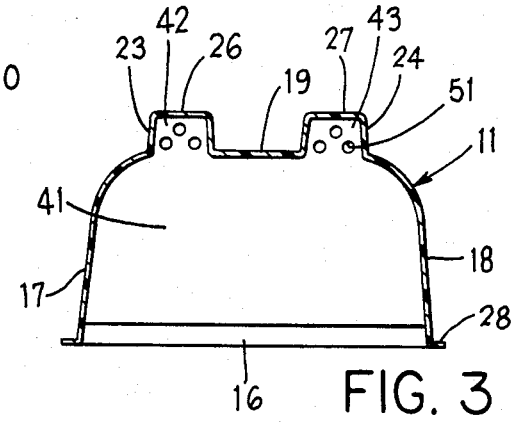
FIG. 3 is a sectional view taken along the line III—III of FIG. 1.

Spaced, rectangular, and substantially coplanar walls 36 and 37 extend upwardly from the bottom wall 16 and inwardly from the respective side walls 17 and 18 near the front edges thereof and are substantially parallel to the rear wall 19. Further spaced walls 38 and 39 extend to the rear wall substantially perpendicular thereto from the inner edges of the side walls 36 and 37, respectively. The walls 36 to 39 have substantially the same vertical height, and a substantially horizontal seat is supported on the upper ends of these walls. The seat 41 has a shape which is substantially congruent with the cross-sectional shape of the shell 11 at that vertical height, as shown in FIG. 3, including two portions 42 and 43 which respectively project into the ridges 23 and 24 of the rear wall 19. The walls 36 to 39 thus define two spaced and substantially closed compartments between the bottom wall 16 and seat 41 and respectively adjacent the side walls 17 and 18. Access to these two compartments is facilitated by openings 46 and 47 provided in the walls 36 and 37, respectively. The area between the two closed compartments, namely the space between the walls 38 and 39, serves as a third, open compartment. A horizontal bar 48 extends across this third compartment and has its ends fixedly secured to the walls 38 and 39.

The seat has three openings 51 through each of the projecting portions 42 and 43 and thus near the peripheral edge thereof.

Figure 4:
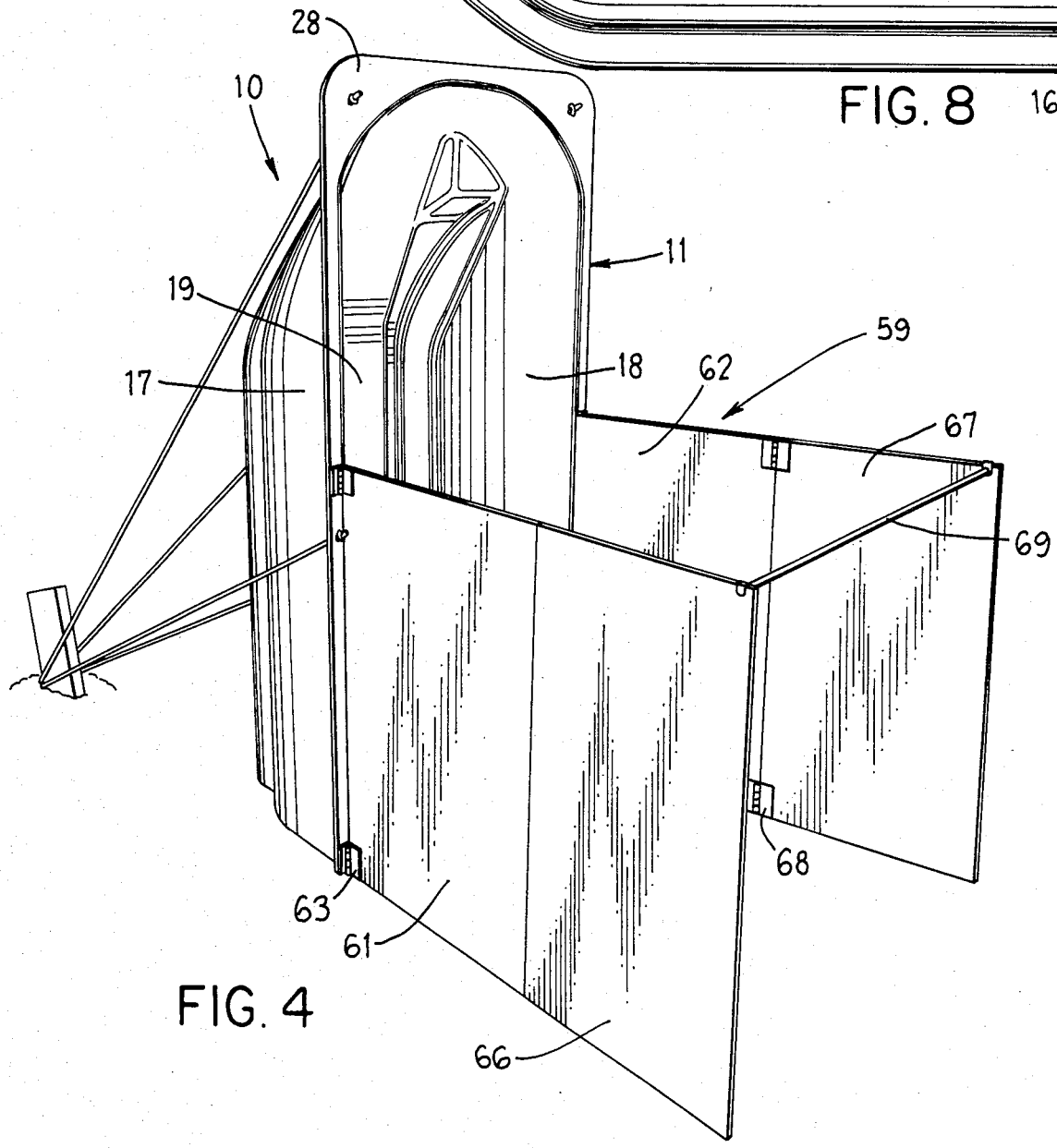
FIG. 4 is a perspective view of the portable shelter of FIG. 1 with a snow blind.

Referring now to FIG. 4, an optional snow blind 59 for the shelter 10 of FIG. 1 is illustrated. The snow blind 59 includes two vertical, rectangular panels 61 and 62 which are pivotally supported on the rim 28 at the front edges of the respective side walls 17 and 18 by hinges, as at 63. The panels 61 and 62 are each pivotal about respective vertical axes between a position projecting forwardly from the rim 28, as shown in FIG. 4, and a position adjacent the seat 41 and approximately parallel to each other and to the rear wall 19.

Further panels 66 and 67, which are preferably identical to the panels 61 and 62, each have an edge pivotally supported on an edge of a respective panel 61 or 62 remote from the shell 11 by means of hinges, as at 68. The panels 66 and 67 are each pivotal about a vertical axis relative to the associated panel 61 or 62 between a position substantially coplanar therewith, as illustrated in FIG. 4, and a position adjacent and substantially parallel thereto.

A brace 69 having at each end a clip adapted to removably grip the top edge of a respective panel 66 and 67 is provided to stabilize the panels 61, 62, 66 and 67.

Figure 6:
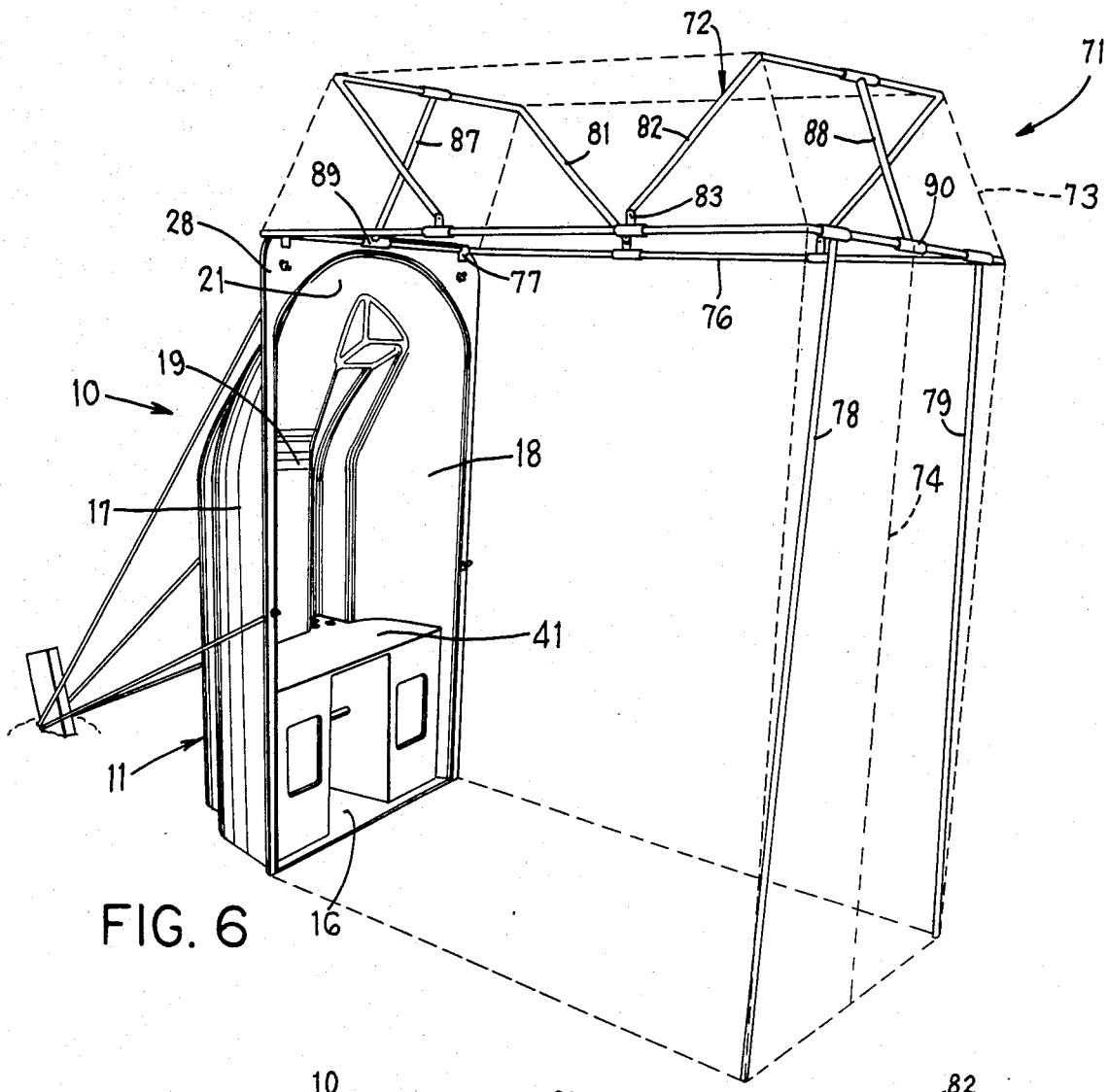
FIG. 6 is a perspective view of the shelter of FIG. 1 with a frame assembly for a collapsible hood.

FIG. 6 illustrates the shelter 10 of FIG. 1 with an optional hood 71. The hood 71 includes a frame assembly 72 and a fabric cover 73 which is shown in broken lines, is supported by the frame assembly 72 and has its lower edges adjacent or touching the frozen surface of the lake or pond. The edges of the fabric cover 73 adjacent the shell 11 can be attached thereto in any convenient manner, for example by snap fasteners provided on the fabric cover and on the rim 28 of the shell 11. The shell 11 and fabric cover 73 thus define a substantially enclosed shelter for the ice fisherman. A vertical slit 74 can be provided in the cover 73 at a location opposite the shell 11 to provide access to the enclosed shelter.

The frame assembly 72 includes a rectangular frame 76 supported for pivotal movement about a horizontal axis on the rim 28 of the shell 11 by means of brackets or hinges, as at 77. Two support legs 78 and 79 have their upper ends pivotally supported at spaced locations on the end of the frame 76 remote from the shell 11, the lower ends of the support legs 78 and 79 engaging the frozen surface of the lake or pond.

Figure 7:
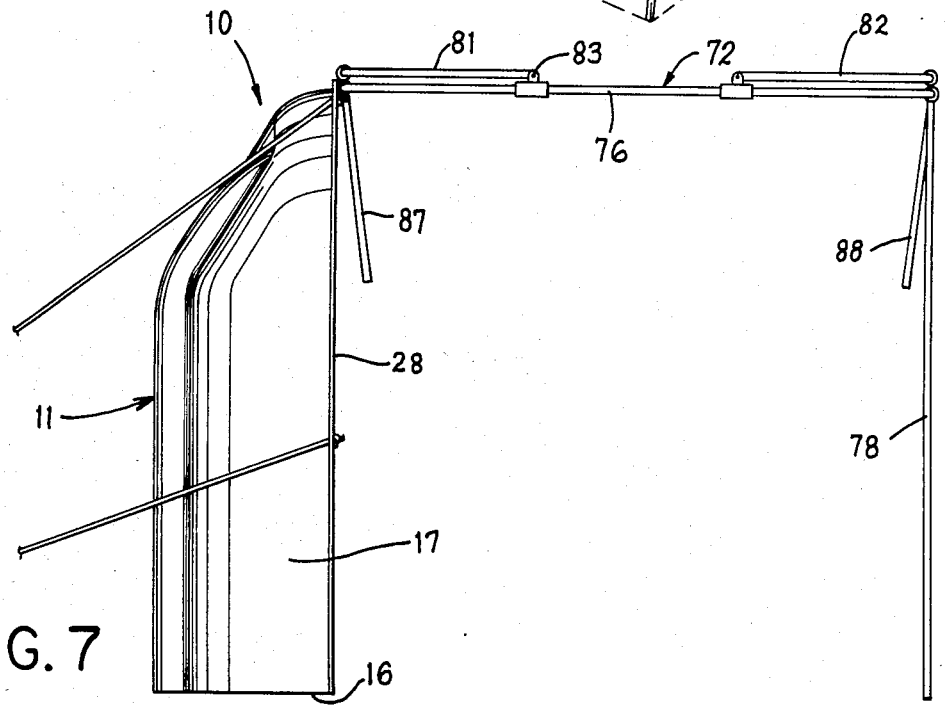
FIG. 7 is a side view of the apparatus of FIG. 6 with the frame assembly partly collapsed.

The frame assembly 72 also includes two U-shaped brackets 81 and 82, each having a bight and two substantially parallel legs, the outer ends of the legs being pivotally supported on respective sides of the frame 76, as at 83. Each of the brackets 81 and 82 is pivotally movable between a position raised above the frame 76, as illustrated in FIG. 6, and a position adjacent the frame 76 in which the legs and bight of each bracket lie immediately above the end and portions of the sides of the frame 76, as shown in FIG. 7.

Two support members 87 and 88 are provided , each having one end pivotally supported in the center of the bight of a respective one of the brackets 81 and 82. The lower end of each of the supports 87 and 88 can be releasably secured in a respective fixture 89 or 90 provided in the center of a respective end of the frame 76 to maintain the brackets 81 and 82 in their raised positions, for example by inserting the lower ends of the supports 87 and 88 into openings in the fixtures 89 and 90.

OPERATION

Figure 2:
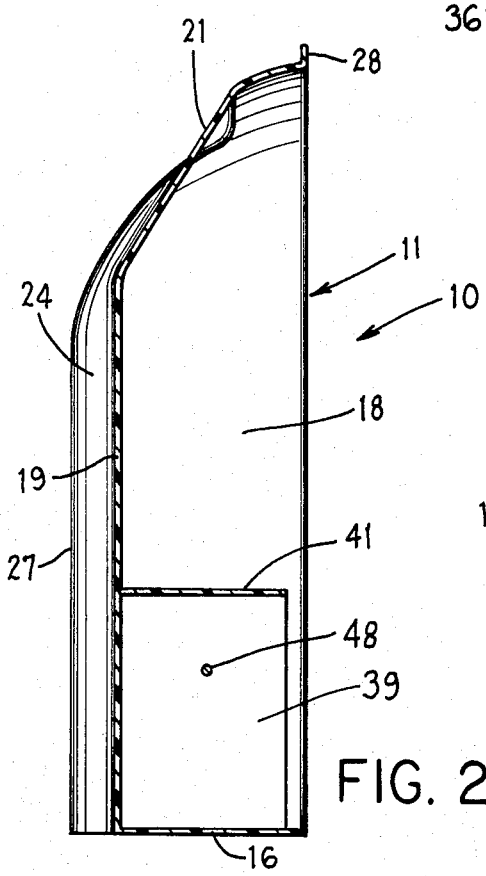
FIG. 2 is a sectional view taken along the line II—II of FIG. 1.

The shelter 10 of FIGS. 1 to 3 can be moved to a fishing location by tilting it 90° counterclockwise from the position of FIG. 2, so that it is supported on the sliding surfaces 26 and 27 of the shell 11, placing therein items such as fishing tackle, a heater, or a lantern, and then using the guy rope 31 to pull the shelter 10 slidably over the ice and snow to the desired location. Fishing poles are typically inserted tip first into the openings 51 in the seat 41. The lantern or heater is typically placed in the center compartment ahead of the horizontal bar 48, the horizontal bar 48 helping to keep the lantern or heater from falling over and spilling fuel or being damaged. The ridge 23 and 24 are provided to reduce the surface area of the shell which is in contact with the snow or ice and thereby reduce sliding friction and thus the force required to pull the shelter 10, and to provide stability to the shell 11 as it is pulled to minimize yaw. The shelter 10 can be pulled manually or, for example, behind a snowmobile.

When the location of intended use is reached, the fisherman merely removes items such as the lantern or heater, orients the shelter 10 so that the outer surface of the top wall 21 is facing into the wind, and then tilts the shelter 10 90° so that it is again supported on its bottom wall 16 in the upright position of operational use illustrated in FIG. 1. As mentioned above, the bottom wall 16 is sufficiently large so that the shelter 10 is relatively stable in this position and will not be blown over by gentle to moderate winds. However, if it is a particularly windy day, the fisherman can add stability to the shelter 10 by driving the stake 32 into the ice a short distance behind the rear wall 19 and then placing the guy ropes 30 and 31 over the stake 32. If the fisherman utilized a snowmobile to reach the fishing location, the guy ropes 30 and 31 could alternatively be attached to the snowmobile.

The fisherman can now chip a hole in the ice, remove a fishing pole from one of the openings 51 and tackle from one of the compartments, place the lantern or heater back in the open central compartment in an upright position, sit down on the seat 41 within the shell 11 and begin to fish. The shell 11 will substantially shield the fisherman from wind and blowing snow. As he catches fish, they can if desired be placed in one of the substantially closed compartments and can remain there until the fisherman gets home.

Figure 5:
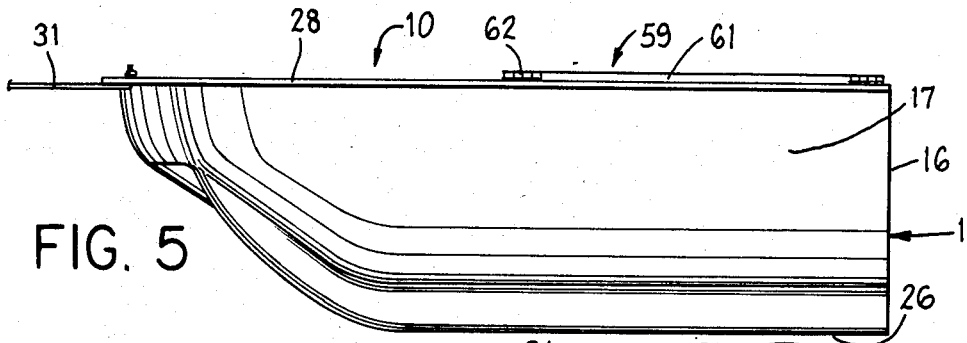
FIG. 5 is a side view of the shelter of FIG. 4 in a horizontal position during transport thereof.

The embodiment of FIGS. 4 and 5 is substantially identical to that of FIG. 1, except that it includes the wind screen 59. Accordingly, this unit is pulled to a fishing location and placed in an upright operational position in substantially the same manner as described above. The shelter will appear as illustrated in FIG. 5 during transport thereof.

Since the panels 61, 62, 66 and 67 will be approximately parallel to the rear wall 19 of the shell 11 when the shelter 10 has been placed in its upright position, the fisherman first pivots the panels 61 and 66 and pivots the panels 62 and 67 approximately 90° so that they all project approximately forwardly, and then pivots the panels 66 and 67 approximately 180° relative to the panels 61 and 62, so that all of the panels are in the position illustrated in FIG. 4. The ends of the brace 69 are then clipped over the top edges of the panels 66 and 67 to add stability thereto. The panels 61, 62, 66 and 67 help prevent snow from blowing into and around the hole chopped into the ice.

When the fisherman wishes to again transport the embodiment of FIGS. 4 and 5, the snow blind 59 is folded to the position shown in FIG. 5 by reversing the sequence of steps just described.

Figure 8:
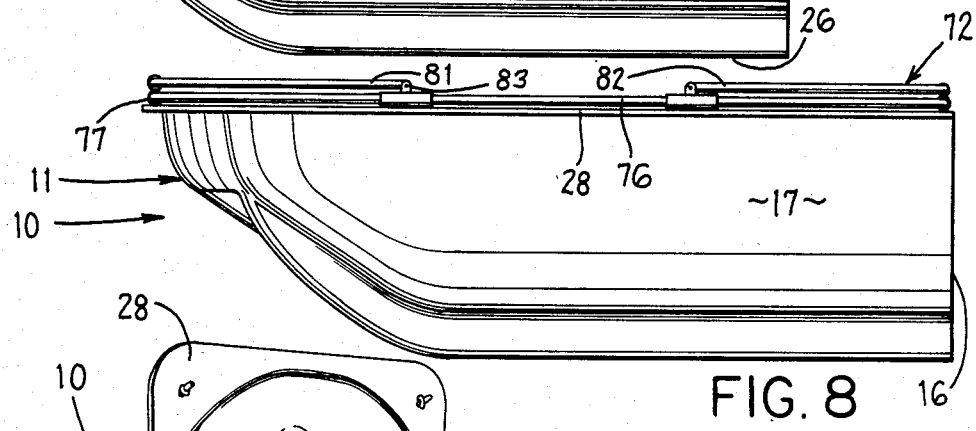
FIG. 8 is a side view of the shelter of FIG. 6 in a horizontal position during transport thereof and with the frame assembly fully collapsed.

The embodiment of FIGS. 6 to 8 also includes a shelter 10 which is substantially identical to that of FIGS. 1 to 3, and is therefore transported to a desired location and placed in an upright position in a manner similar to that already described. Since the hood assembly 71, including the frame assembly 72 and fabric cover 73 (FIG. 6) substantially cover the shell 11 during transport thereof, as illustrated in FIG. 8, they prevent falling snow from accumulating within the shell 11. When the desired fishing location is reached and the shell 11 has been placed in an upright position, the hood 71 is erected by grasping the end of the rectangular frame 76 which is adjacent the bottom wall 16 of the shell 11 and pivoting the frame 76 90° upwardly to the position illustrated in FIG. 6 and then pivoting the support legs 78 and 79 approximately 90° from a position substantially parallel to the frame 76 to the position illustrated in FIGS. 6 and 7. The supports 87 and 88 are each pivoted approximately 90° from a position substantially parallel to the sides of the frame 76 to the position illustrated in FIG. 7, the brackets 81 and 82 are each pivoted to the raised position illustrated in FIG. 6, and then the lower ends of the supports 87 and 88 are releasably secured to the fixtures 89 and 90.

When the fisherman thereafter decides to transport the shelter to a different location, the hood 71 is collapsed to the position illustrated in FIG. 8 by performing the sequence of steps just described in a reverse order.

Although preferred embodiments of the invention have been disclosed in detail for illustrative purposes, it will be recognized that variations or modifications thereof, including the rearrangement of parts, lie within the scope of the present invention.

The embodiments of the invention in which an exclusive property or privilege is claimed are defined as follows:

1. A portable shelter, comprising a shell having spaced, upstanding side walls, an upstanding rear wall extending between the rear edges of said side walls, and a top wall extending between the upper edges of said side and rear walls, means for supporting said shell in an upright operational position, means defining a seat between said side walls and means defining a sliding surface on the outer side of said rear wall for slidably supporting said shelter on ice and snow to facilitate transport thereof; wherein said means for supporting said shell in an upright position includes said shell having a bottom wall, said side and rear walls extending upwardly from the peripheral edges of said bottom wall; wherein said seat is spaced above said bottom wall, and including wall means defining at least one compartment in the region between said side walls, seat and bottom wall; wherein said wall means defines first and second spaced and substantially closed compartments located adjacent respective said side walls, said wall means having means defining at least two openings therein for providing access to said first and second compartments, respectively; and wherein the space between said first and second compartments serves as a third, substantially open compartment.

2. The shelter according to claim 1, wherein said shell is molded, wherein said bottom, side, rear and top walls are integral portions of said shell, and wherein said top wall is inclined downwardly and rearwardly and merges smoothly into said rear wall.

3. The shelter according to claim 1, including a substantially horizontal bar supported on said wall means and extending through said third compartment.

4. The shelter according to claim 1, including spaced, vertically extending outward projections on said rear wall, said means defining a sliding surface including a sliding surface portion on each said projection.

5. The shelter according to claim 1, including at least one opening through said seat near a peripheral edge thereof.

6. The shelter according to claim 1, including a generally rigid and vertical first panel supported on a forward edge of each said side wall and extending forwardly therefrom.

7. The shelter according to claim 6, wherein said first panels are pivotally supported on said forward edges of said side walls, have widths less than the distance between said forward edges of said side walls and are each pivotally movable about a first axis between said forwardly projecting position and a position adjacent said seat and generally parallel to said rear wall.

8. The shelter according to claim 7, including two further panels substantially identical to said first panels, each having an edge supported on an edge of a respective said first panel opposite said one edge thereof for pivotal movement about a second axis between a position projecting forwardly from the associated first panel generally parallel thereto and a position adjacent and parallel to the associated first panel, and including brace means cooperable with each of said further panels for effecting stabilization thereof.

9. The shelter according to claim 1, including a frame assembly supported on said shell near the top thereof and extending forwardly therefrom; including at least one generally vertical support leg engageable with a support surface on which said shell is supported and supporting said frame assembly at a location thereon remote from said shell; and including a fabric cover supported on said frame assembly and extending downwardly to a location substantially adjacent said support surface.

10. The shelter according to claim 9, wherein said frame assembly includes a substantially rectangular frame, the width thereof being approximately equal to the distance between the front edges of said side walls, one end of said frame being pivotally supported on said shell adjacent the front edge of said top wall for movement about a substantially horizontal first axis, and said support leg being pivotally supported on the other end of said frame for movement about a generally horizontal second axis to a position adjacent and substantially parallel to said frame, and said frame being movable about said first axis to a position substantially parallel to said rear wall.

11. The shelter according to claim 10, wherein said frame assembly includes two brackets pivotally supported on said frame adjacent opposite ends thereof, each said bracket being movable between a position adjacent and substantially parallel to said frame and a raised position projecting above said frame, and including means for retaining said brackets in said raised positions.

12. The shelter according to claim 1, including means provided on said shell at a location spaced from said bottom wall for attaching a line to said shelter.

* * * * *